US005826528A

United States Patent [19]

Jancsek

[11] Patent Number: 5,826,528

[45] Date of Patent: Oct. 27, 1998

[54] FLOATING BOAT LIFT WITH RETRACTING WALKWAY

[76] Inventor: John J. Jancsek, 11849 Madison St. NE., Blaine, Minn. 55434

[21] Appl. No.: 794,626

[22] Filed: Feb. 3, 1997

Related U.S. Application Data

[60] Provisional application No. 60/011,101 Feb. 5, 1996.

[51] Int. Cl.[6] ..... B63C 1/02

[52] U.S. Cl. ..... 114/45; 114/48

[58] Field of Search ..... 114/45–48, 44; 405/3, 4

[56] References Cited

U.S. PATENT DOCUMENTS

| | | |
|---|---|---|
| 1,752,894 | 5/1930 | Degn . |
| 3,951,087 | 4/1976 | Carson . |
| 4,072,119 | 2/1978 | Williams . |
| 4,686,920 | 8/1987 | Thomas . |
| 4,750,444 | 6/1988 | Lemvig . |
| 4,773,346 | 9/1988 | Blanding . |
| 4,955,308 | 9/1990 | Craddock . |
| 5,099,778 | 3/1992 | Palen . |

FOREIGN PATENT DOCUMENTS

| | | | |
|---|---|---|---|
| 11131 | 8/1894 | United Kingdom | 114/48 |

*Primary Examiner*—Ed. L. Swinehart

[57] ABSTRACT

A floating boat lift for raising a boat out of and securing same above a body of water. This boat lift consists of two float supported frames which are held parallel and separated by two parallel lift bars which are held parallel and separated by a pair of support bunks and, or, two crossed spacing members. The lift bars are attached to the float supported frames through the use of a pair of 7-link mechanisms on each end of each of the lift bars. These mechanisms, referred to as cascaded four bars in the following sections, are positioned such that the lift bar are between a pair on each end of the lift bars.

18 Claims, 7 Drawing Sheets

FLOATING BOAT LIFT WITH RETRACTING WALKWAY

This application claims priority to Provisional Application No. 60/011,101, filed Feb. 5, 1996.

BACKGROUND AND OBJECTS OF THE INVENTION

1. Field of the Invention

The present invention relates to an improvement in vertical lift floating boat lifts for lift and storing watercraft above a body of water. Here, watercraft is used in the broadest sense to include any craft powered by engine, sail or nonpowered for recreational, business or rescue use. Also included as watercraft would be any water landing aircraft or any amphibious vehicle.

2. Description of Prior Act

Boat lifts which have been developed in the past are of a wide variety. Of the floating lifts there are primarily only two types. The first are lifts which control buoyancy of a large tank or set of tanks or pontoons. Applicant is aware of a number of boat lifts of the first type including U.S. Pat. Nos. 5,394,814, 4,750,444, 4,072,119, and 3,951,087. The present invention is an improvement over each of these in several ways. First, water is not pumped into or out of pontoons with the present invention eliminating the need for in-line filters and all the associated seals and piping. Secondly, an existing jetty, dock, or pier is not required with the present invention since it can be a stand alone unit which, in its preferred embodiment, is a central component to a floating jetty or marina system.

The second type are those lifts which employ a rigid frame work supported by multiple floatation modules or pontoons with a second rigid frame work which is lowered into the water in a controlled manner from the first rigid frame work. Applicant is aware of a number of boat lifts of the second type including U.S. Pat. Nos. 5,099,778, 4,955,308 and 1,752,894.

The present invention is an improvement over the craft lift as shown by U.S. Pat. No. 5,099,778 to Palen since the rigid frame work is significantly reduced and components of the present invention do not extend above the user access walkways on top of the float supported frames. The present invention is an improvement over the Floating Boat Lift as shown by U.S. Pat. No. 4,955,308 to Graddock since resistance to the twisting forces, or moments, has been significantly reduced to allow the structure to be more lightweight while raising the craft vertically instead of in a sweeping arc, which is an inherently safer and more stable operation. The present invention is also an improvement over the Floating Dock for Water Aircraft as shown in U.S. Pat. No. 1,752,894 to Degn since it is unincumbered by the frame work which remains submerged after the craft is raised and does not require the synchronization of four hydraulic cylinders.

In addition to the improvements over prior art noted above the present invention in its preferred embodiment has a retractable walkway which provides a means of moving between the float supported frames and potentially can allow the invention to provide access to all sides of a raised craft. Additionally this retracting walkway can be configured to raise and hold a personal watercraft, such as a jet ski, above the water. It is the primary object of this invention to provide a floating lift which will raise a watercraft vertically from and cradle same in a position above a body of water. A further object of this invention is to provide a floating lift which will be free of obstruction above the solid decking surface to ensure complete usability of the user accessible area. It is a still further object of this invention to provide a floating lift with a retracting walkway which will allow user access to all sides of a raised craft. It is a still further object of this invention to provide a central mechanism around which a floating jetty or marina system can be based. A still further object of this invention is to provide a stabilized walkway on the float supported frames even in the lowered configuration for ease of user access. Through the following descriptions as well as the accompanying diagrams other objects as well as those noted above will become apparent. It should be understood that the indicated preferred embodiments are provided as an example of the range of application configurations of the invention and various changes or modifications can be made without departing from the spirit and scope of the invention described in the detailed description.

SUMMARY OF THE INVENTION

The objects listed above are accomplished in the present invention which is a significant departure from and improvement over prior act. This improved lift utilizes a pair of rigid frames which are supported by multiple floatation modules and held parallel and separated only by the cradle on which the craft is to be raised from, lowered to or held above a body of water. Cable is utilized to vertically move both the craft cradle and the retracting walkway with all actuating accomplished on only one of the two float supported frames. The craft cradle is comprised of two lift bars, bunks on which the craft rests and a pair of crossed spacing members. Size, quantity and shape of the lift bars and bunks as well as the size, quantity and location of the floatation modules is configured for the type and size of craft to be handled by the present invention.

The lift bars of the craft cradle are connected at each end to the float supported frames through a pair of cascaded four bars which are linked to the cascaded four bars on the opposite end of the lift bar. Linking the cascaded four bars across the lift bars ensures that the craft cradle will be raised and lowered while remaining parallel to the plane of the float supported frames and at the same time stabilizing the float supported frames for improved user comfort and safety.

The retracting walkway is connected to each of the float supported frames on each end of the retracting walkway through a pair of scissor mechanisms. The scissor mechanisms on one end of the retracting walkway are linked to the pair of scissor mechanisms on the opposite end of the retracting walkway. This interconnection of the scissor mechanisms allows the retracting walkway to be raised and lowered while remaining parallel with the plane of the float supported frames. This retracting walkway is raised and lowered through the use of cables, which are routed through pulleys in a pulley block to an adjustable anchoring position. A third cable connects this pulley block to the actuating device. Routing the cables from the retracting walkway through pulleys in a pulley block provides a single level of mechanical disadvantage allowing the retracting walkway to be lowered twice as far as the craft cradle so as to ensure clearance for propellers and motor lower units.

DETAILED DESCRIPTION OF THE INVENTION

Figure 1:
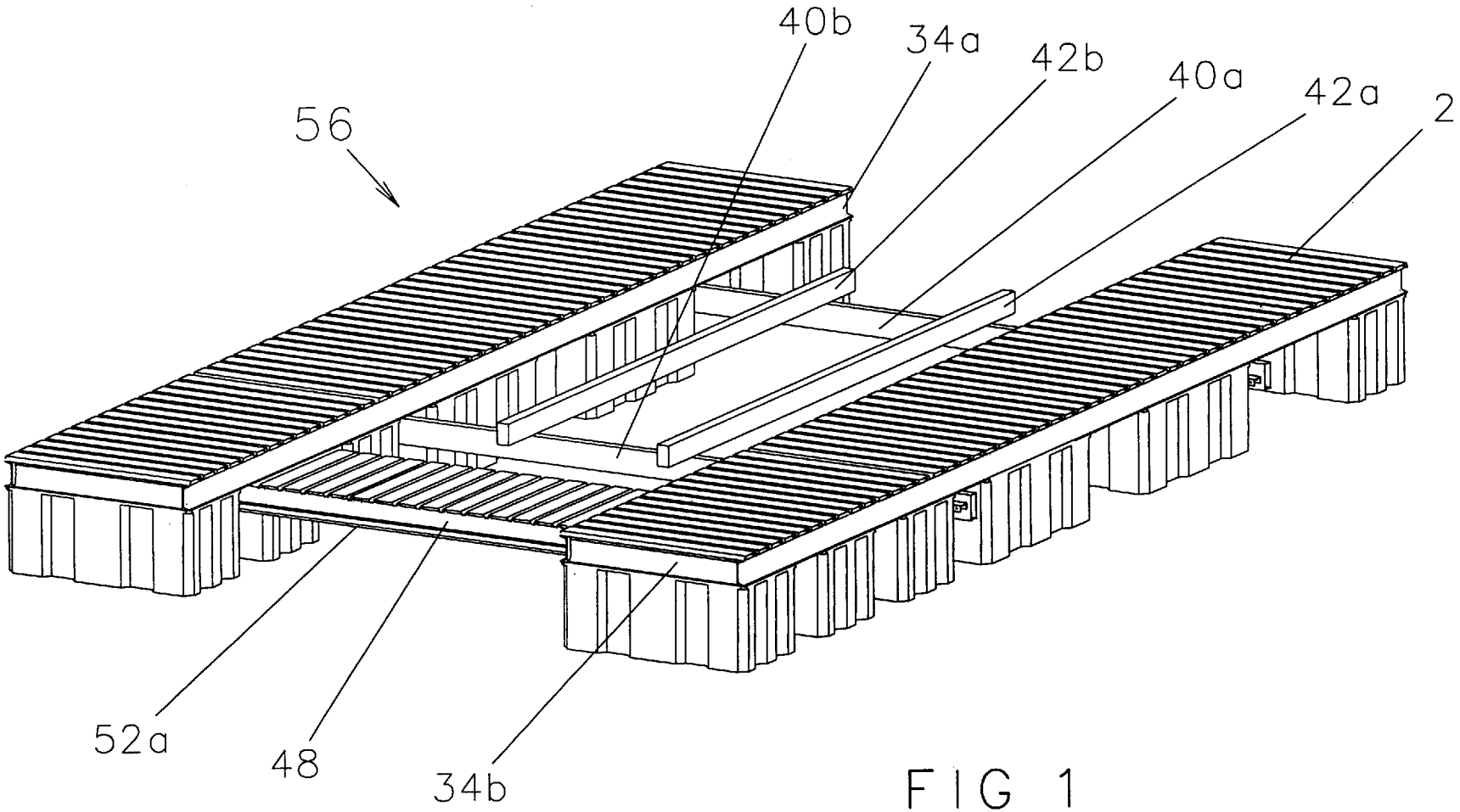
FIG. 1 is a perspective view of the invention in a raised position.

Referring now to FIG. 1 where identical parts are marked with the same numbers, the invention is shown in its preferred embodiment. The boat lift 56 consists of two float supported frames 34 supported by a number of floatation modules 36 which are held separated and parallel by a pair of lift bars 40 and a retracting walkway 48. The boat lift 56 is shown in the raised position. The bunks 42*a* and 42*b* can be seen supported by two lift bars 40*a* and 40*b*. It can be seen that the retracting walkway 48 provides a path for user access from one float supported frame 34 to the other. FIG. 1 shows the decking 2 on top of both float supported frames 34 as well as the retracting walkway.

Figure 2:
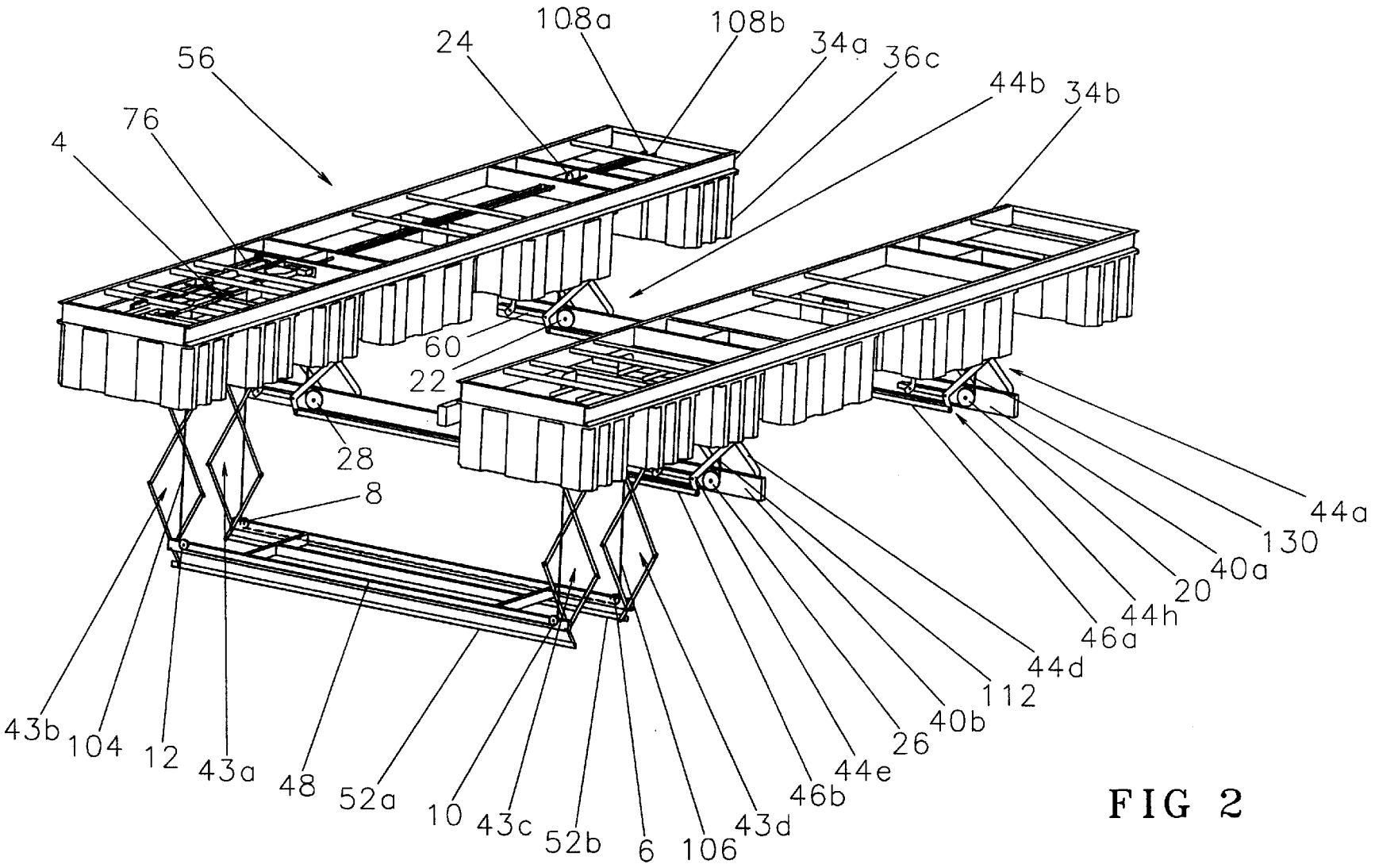
FIG. 2 is a perspective view of the invention in a lowered position with the decking not shown.

Referring now to FIG. 2, the boat lift 56 is shown in the lowered position without decking. The first float supported frame 34*a* has within it the actuating device 76, the locking mechanism 4 and the slidable rods 108*a* and 108*b*. The retracting walkway 48 is attached to each float supported frame 34 by two scissor linkages 43, the second cable 104 and the third cable 106. The second cable 104 is anchored on one end to the second float supported frame 34*b* and from there is routed down to and around pulley 6 attached to the retracting walkway, over to and around pulley 8 also attached to the retracting walkway, and then up to the first float supported frame 34*a*. The third cable 106 is anchored on one end to the second float supported frame 34*b* and from there is routed down to and around pulley 10 over to and around pulley 12 and then up to the first float supported frame 34*a*. The scissor mechanisms 43 are positioned and pivotally attached at each of the four corners of the retracting walkway 48 and pivotally attached to the float supported frame 34 positioned above each of the respective corners. It can also be seen in FIG. 2 that the lift bar 40*a* is attached to the second float supported frame 34*b* by the fifth cable 130 and the cascaded four bar mechanisms 44*a* and 44*b*. Lift bar 40*a* is also attached to the first float supported frame 34*a* by the fifth cable 130 and the cascaded four bar mechanisms 44*b* and 44*c*. The fifth cable 130 is anchored on one end to the second float supported frame 34*b* and from there is routed down to and around pulley 20 attached to lift bar 40*a*, over to and around pulley 22 attached to lift bar 40*a*, and then up to and around pulley 24 which is attached to the first float supported frame 34*a*. From pulley 24 the fifth cable 130 is routed to the cable mount 110*b* and anchored there. The cable mounts 110*a* and 110*b* are each attached to both the slidable rods 108*a* and 108*b*.

Figure 3:
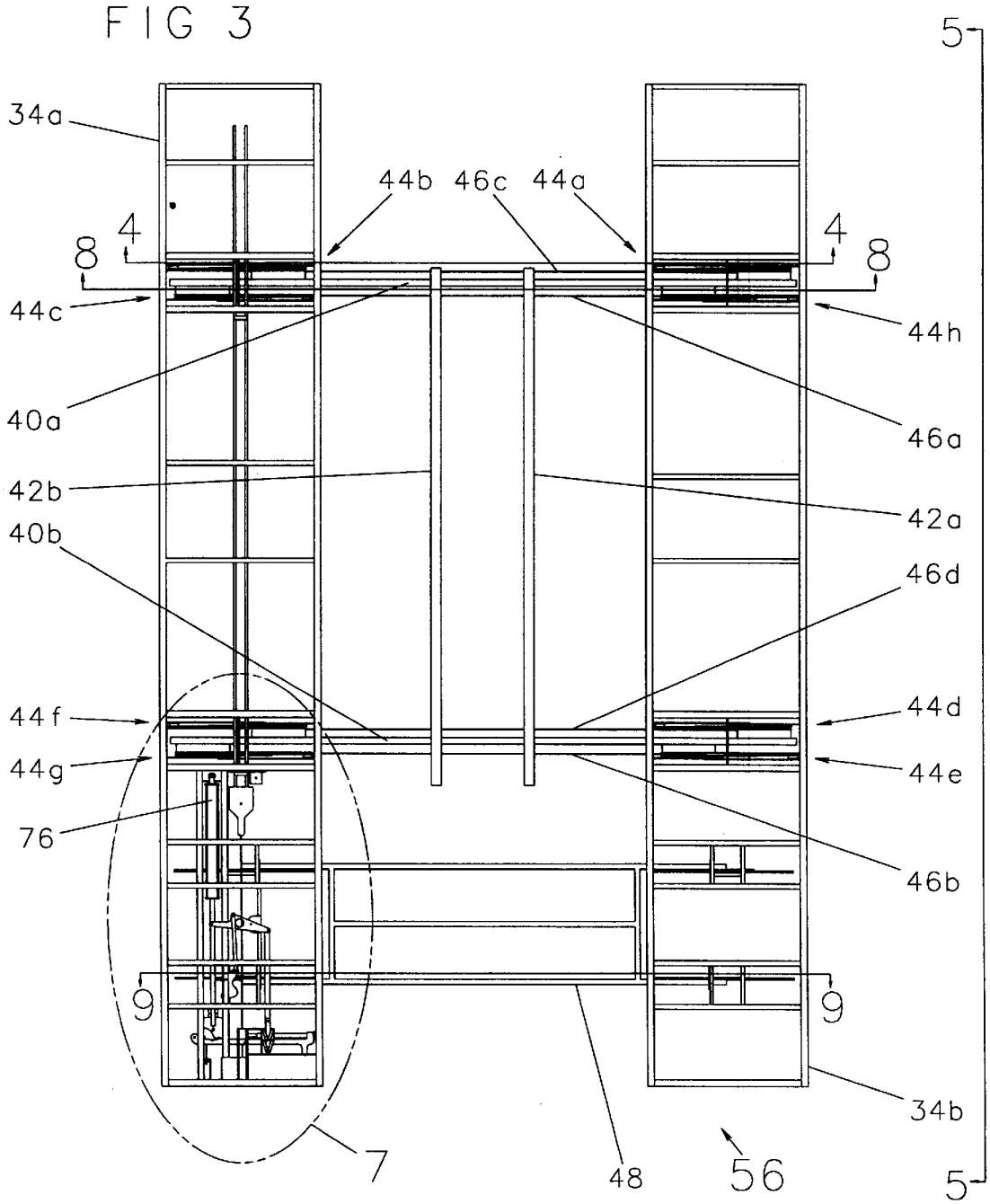
FIG. 3 is a plan top view of the invention with the decking not shown.

Referring now to FIG. 3 it can be seen that on each side and at each end of each of the lift bars 40*a* and 40*b* is a cascaded four bar mechanism 44. Cascaded four bar mechanism 44*a* is pivotally connected to inter four bar link 46*c* which is pivotally connected to the cascaded four bar mechanism 44*b*. Cascaded four bar mechanism 44*h* is pivotally connected to inter four bar link 46*a* which is pivotally connected to the cascaded four bar mechanism 44*c*. Cascaded four bar mechanism 44*d* is pivotally connected to inter four bar link 46*d* which is pivotally connected to the cascaded four bar mechanism 44*f*. Cascaded four bar mechanism 44*e* is pivotally connected to inter four bar link 46*b* which is pivotally connected to the cascaded four bar mechanism 44*g*.

Figure 4:
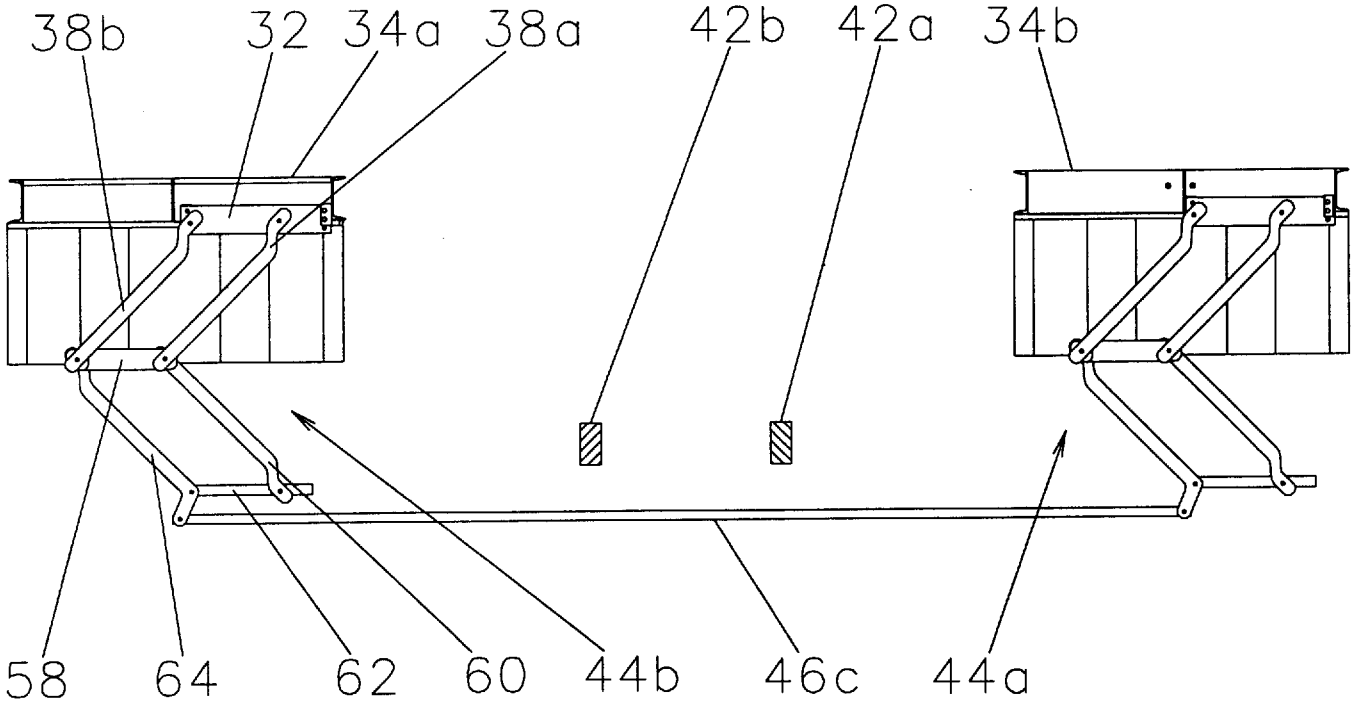
FIG. 4 is a section view of the invention in the lowered position.

Referring now to FIG. 4 it can be seen that cascaded four bar mechanism 44*b* has a top link 32 which is attached to the first float supported frame 34*a*. The first links 38*a* and 38*b* of the cascaded four bar mechanism 44*b* are pivotally attached at one end to the top link 32 and are both pivotally attached at the other ends to the center link 58. The short cascade bottom link 60 is pivotally attached at one end to the center link 58 and is pivotally attached at the other end to the bottom link 62 which is attached to the lift bar 40*a* shown in FIG. 1. Still referring to FIG. 4, the long cascade bottom link 64 is pivotally attached at one end to the center link 58 and pivotally attached to the bottom link 62. The long cascade bottom link 64 extends below the pivotal connection to the bottom link 62 to a pivotal connection to the inter four bar connecting link 46*c*. It can now be seen that the links 32, 38*a*, 38*b* and 58 are positioned relative to each other such that a parallelogram is formed. It can also be seen that links 58, 62, 64 and 60 are positioned relative to each other such that a parallelogram is formed. It can further be seen that these link positions cause the top link 32, center link 58 and the bottom link 62 to remain parallel to each other through out their ranges of motion.

Figure 5:
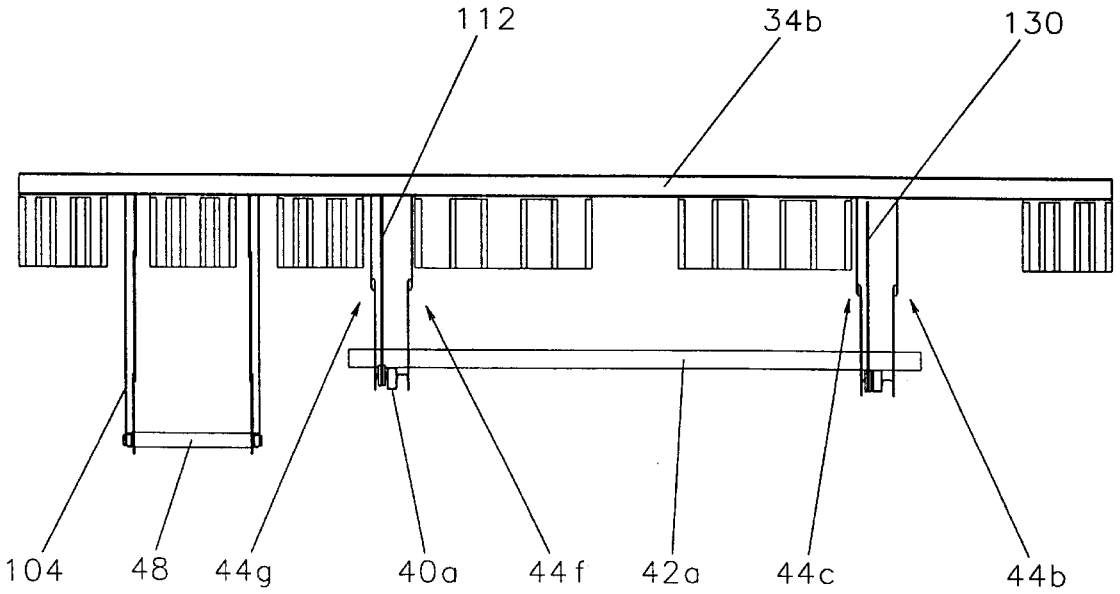
FIG. 5 is a right side elevation view of the invention in a lowered position.

Referring now to FIG. 5 it can be seen that the cascaded four bar mechanisms 44 are positioned such that they are on both sides of the lift bars 40*a* and 40*b*.

Figure 6:
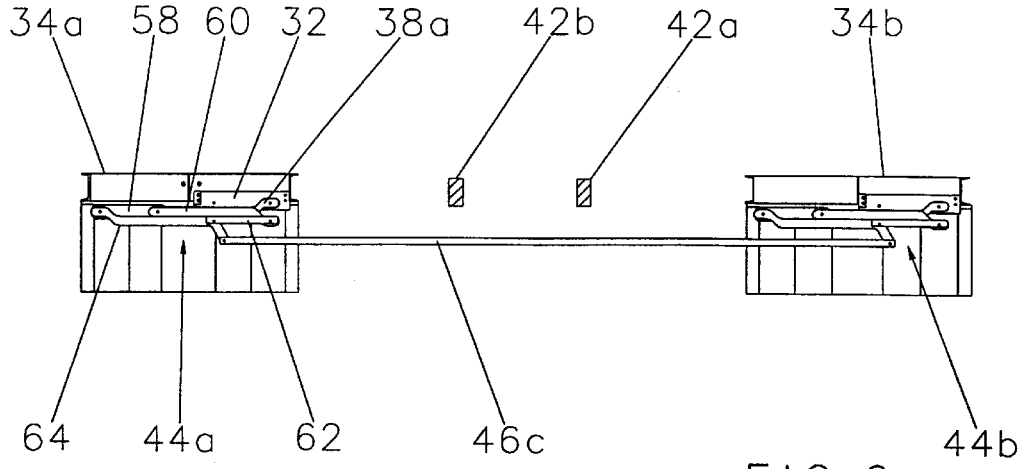
FIG. 6 is a section view taken at section 4 of FIG. 3 of the invention in the raised position.

Referring now to FIG. 6 it can be seen that the cascaded four bar mechanism 44*a* moves to a position where all of the links of the mechanism are contained below the first float supported frame 34*a* once in the raised position.

Figure 7:
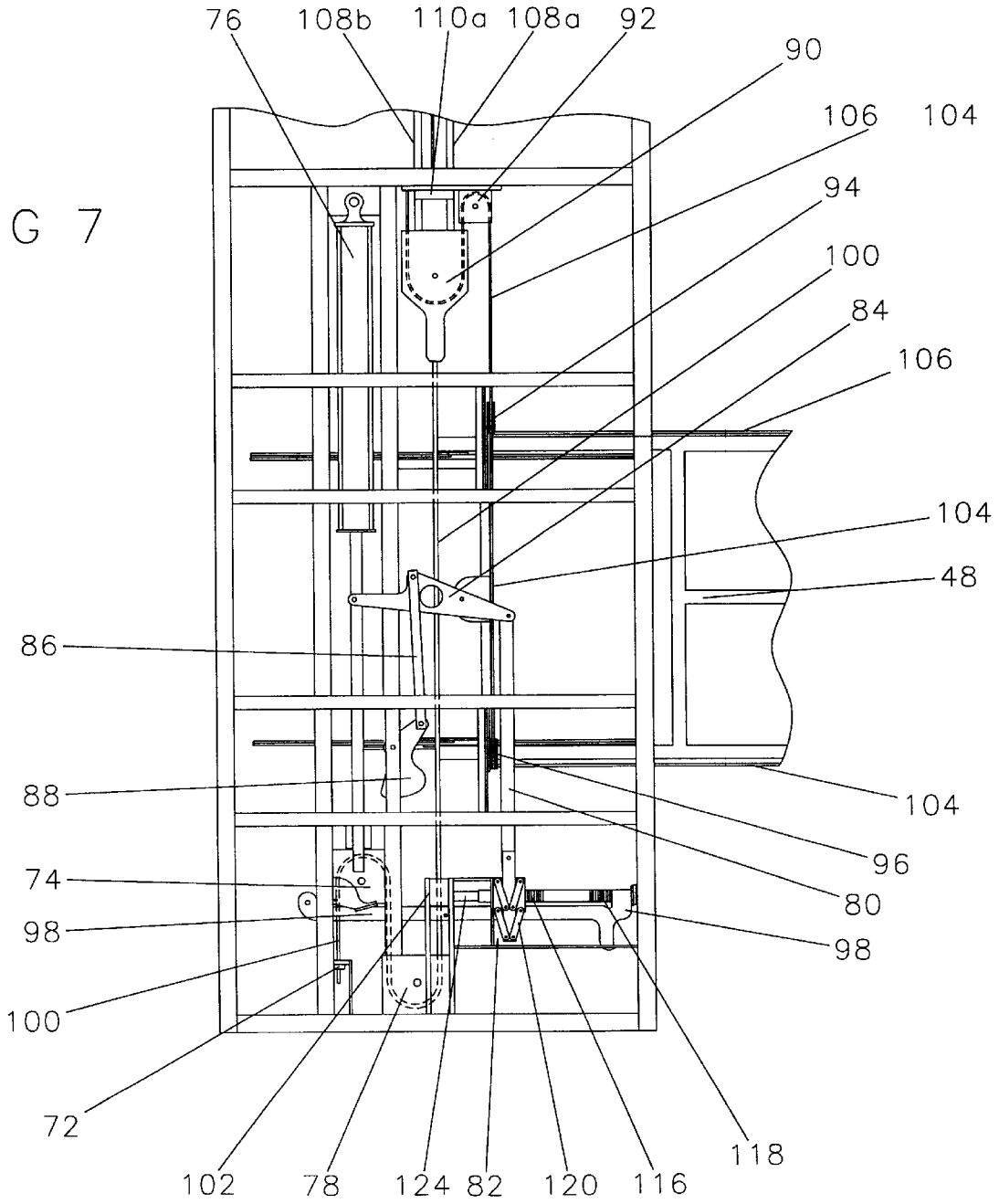
FIG. 7 is a top plan detail view of the area of the locking and actuating section of the invention in the lowered position.

Referring now to FIG. 7, the actuating device 76 is attached to the float supported frame 34*a* on one end and is fastened to the first pulley block 74 on the other end. The first cable 100 is anchored to the float supported frame 34*a* at the cable anchor 72 and is routed around a pulley in the first pulley block 74 and then around the pulley in the first pulley housing 78 which is attached to the float supported frame 34*a*. From the first pulley housing 78 the first cable 100 is then routed through the locking port 102 which is attached to the float supported frame 34*a*, to an anchoring position on the second pulley block 90. Attached to the second pulley block 90 are two rods 108*a* and 108*b* to which are attached cable mounts 110*a* and 110*b* (110*b* is shown in FIG. 2). A toggle assembly 82 is attached to the float supported frame 34*a* on one end of the assembly and to the locking port 102 on the other end of the assembly. The toggle assembly 82 consists of multiple toggle links 120, a center toggle link 122, a return spring 116, an enable spring 118, and a lock pin 124 with a lock pin stop tab 126. When the enable spring 118 is in compression the force in the spring is against the lock pin 124 in a direction which would move the lock pin 124 into and through the locking port 102. When the return spring 116 is in compression the force in the spring is against the lock pin 124 in a direction which would move the lock pin 124 out of the locking port 102. Interfacing with the toggle assembly is a lock pin release link 98 which is pivotally connected to the float supported frame 34*a*. Pivotally attached to the toggle center link 122 is a toggle connecting link 80 which in turn is pivotally connected to toggle reset link 84. The toggle reset link 84 is also pivotally attached to the pivot connecting link 86. Between the pivot connections to the toggle connecting link 80 and the pivot connecting link 86 the toggle reset link 84 is pivotally attached to the float supported frame 34*a*. The pivot connecting link 86 is pivotally attached to the enabling pivot link 88. With the lift bars 40 and the retracting walkway 48 in the lowered position the actuating device 76 is activated which causes the first pulley block 74 to move away from the cable anchor 72 in turn causing all cables within the invention to become taught. The second pulley block 90 moves toward the locking port 102 causing the second cable 104 and the third cable 106 to move around the pulleys attached to the retracting walkway 48 at twice the rate of the fourth cable 112 and the fifth cable 128 move around the pulleys attached to the respective lift bars. As the lift bars 40 are brought closer to the float supported frames 34 they are maintained parallel to both the float supported frames 34*a* and 34*b* by the inter connection of the cascaded four bar mechanisms 44, on each end of the lift bars 40. In an alike manner the retracting walkway is maintained parallel to each of the float supported frames 34 by the inter connection of the scissor mechanisms 43, on each end of the retracting walkway 48, through the scissor connecting link 52. As the lift bars 40 reach the raised position a portion of the second pulley block 90 moves into the locking port 102 and the lock pin release link 98 is contacted by the second pulley block 90. As the second pulley block 90 moves to the end of its travel the lock pin release link 98 is pivoted sufficiently to move away from contact with the lock pin stop tab 126 and the lock pin 124 is free to slide into the locking port 102 and through a hole in the second pulley block 74 by the force in the enable spring 118. The direction of travel of the actuating device 76 is now reversed such that the first pulley block 74 is moved closer to the cable anchor 72 allowing the second pulley block 90 to move away from the lock pin release link 98. As the actuating device continues to move in this direction the second pulley block 90 contacts the lock pin 124 which prevents the second pulley block 90 from moving out of the locking port 102 and the tension force in the first cable 100 goes to zero. Now the invention is in the raised position with the load from the second 104, third 106, fourth 112, and fifth 128 cables being supported by the lock pin 124 in the locking port 102.

Figure 8:
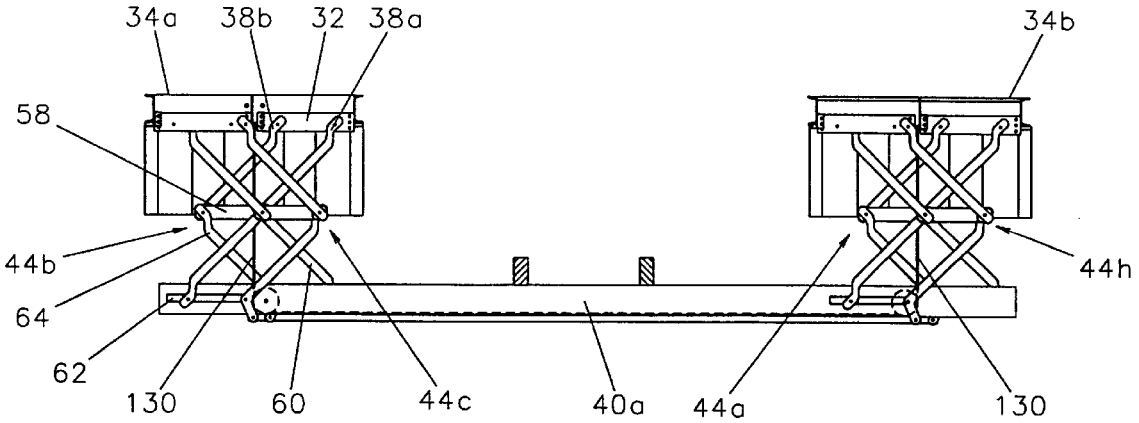
FIG. 8 is a section view of the invention in the lowered position.

Referring now to FIG. 8 it can be seen that the orientation of the cascaded four bar mechanisms 44*b* and 44*a* are opposite of the orientation of the cascaded four bar mechanisms 44*c* and 44*h*. The orientations of the inter connected pair of cascaded four bar mechanisms 44 on one side of lift bar 40*a* are opposite of the orientations of the inter connected pair of cascaded four bar mechanisms 44 on the other side of the lift bar 40*a*. It can be seen that by having a second cascaded mechanism 44 on each end of each lift bar opposite in orientation to the first cascaded four bar mechanism 44 there, that the motion of the float supported frames 34, relative to the lift bars 40, is restricted to vertical only. This restriction of motion prevents the float supported frames 34*a* and 34*b* from moving toward or away from each other while the invention is not in the raised position. In this way the second cascaded four bar mechanisms at each end of each of the lift bars 40 are float supported frame stabilizers extending between the float supported frames 34 through the inter four bar link 46.

Figure 9:
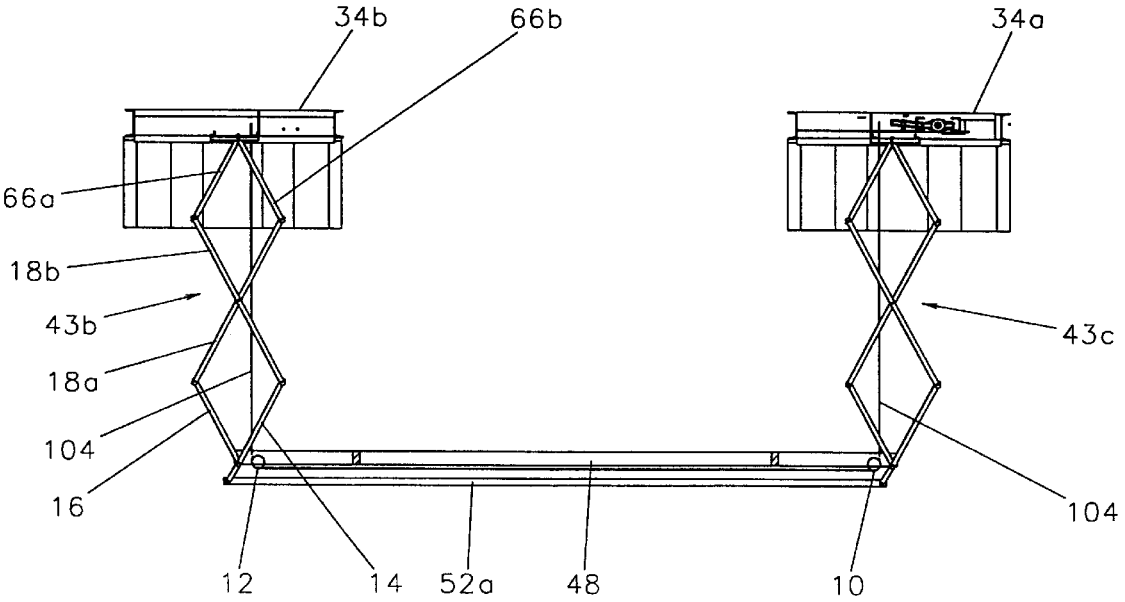
FIG. 9 is a section view of the invention in the lowered position.

Referring now to FIG. 9 the scissor linkages 43*b* are shown to be composed of a longer bottom link 14, a shorter bottom link 16, two middle scissor links 18*a* and 18*b* and two top scissor links 66*a* and 66*b*. The top scissor links 66 are pivotally connected at one end to the second float supported frame 34*b* and to the middle scissor links 18 at the other ends. The middle scissor links 18*a* and 18*b* are pivotally attached to each other at center point of each. The longer bottom link 14 and the shorter bottom link 16 are pivotally attached to each other at the point of their pivotal attachment to the retracting walkway 48 and to one or the other of the middle scissor links 18 at the other of their respective ends. The longer bottom link 14 of scissor linkage 44*b* extends below the pivot connection with the retracting walkway 48 to a pivotal connection with the scissor connecting link 52*a* which is pivotally connected to the scissor linkage 43*c* positioned on the other end of the retracting walkway 48.

Referring now to all of the figures. To move the invention to the lowered position the actuating device 76 is first moved such that the first pulley block 74 moves closer to the cable anchor 72. As the first pulley block 74 contacts the toggle reset link 84 the link 84 is caused to rotate about the connection with the float supported frame 34. This rotation moves the toggle connecting link 80 away from the toggle assembly 82 which pulls the toggle center link 122. As the toggle center link 122 moves toward the toggle reset link 84 the toggle links 120 are moved to a configuration position which makes the toggle linkage 128 larger which compresses the return spring 116 such that the force in the enable spring 118 is less that the force in the return spring 116. The operation of toggle mechanisms is assumed known to those skilled in the art. Now the direction of the actuating device 76 travel is reversed, the first cable 100 becomes taught, the second pulley block 90 moves to contact the lock pin release link 98. As the second pulley block 90 moves to the end of its travel the lock pin release link 98 is pivoted sufficiently to move it away from contact with the lock pin stop tab 126 and the lock pin 124 is free to slide out of the locking port 102 by the force in the return spring 116. Now the direction of the actuating device 76 travel is again reversed and the second pulley block 90 moves out of the locking port 102, the lift bars 40 and retracting walkway 48 move toward the lowered positions and the first pulley block 90 contacts the enabling pivot link 88. As the first pulley block 90 continues to move toward the cable anchor 72 the enabling pivot link 88 is contacted and caused to rotate about the connection to the first float supported frame 34*a* causing the pivot connecting link 86 to move which rotates the toggle reset link 84. This rotation of the toggle reset link 84 causes the toggle connecting link 80 to push the toggle center link 122 away from the toggle reset link 84 and the toggle links 120 are moved to a configuration position which makes the toggle linkage 128 smaller which uncompresses the return spring 116 such that the force in the enable spring 118 is larger than the force in the return spring 116. The actuating device 76 continues to move in the same direction until the lift bars 40 and the retracting walkway 48 are in the lowered position.

It can now be seen that the boat lift 56 of the present invention uniquely distinguishes itself from prior art in its ease of use and inherent stability. This stability is afforded to the present invention through the unique use of inter connected cascaded four bar mechanisms which maintain the lift bars 40 level with respect to the float supported frames 34 while at the same time preventing the float supported frames 34 from tilting, or rolling to one side or the other. Ease of use is seen in the inventions ability to support user access to the rear of the raised watercraft by way of the retracting walkway 48 while also allowing the watercraft to enter and exit the boat lift 56 from the same end of the invention where the retracting walkway is positioned. It can also be seen that the invention accomplishes the object of having no structural component below the surface of the body of water or above the top of the float supported frame 34 when in the raised position.

I claim:

1. A boat lift, comprising:

a frame having spaced apart first and second support members;

a lift bar extending between the first and second support members;

a first linkage, including:

a pair of spaced apart first upper bars, each pivotably attached to the first support member;

a first cross member pivotably attached to the first upper bars such that the first upper bars are maintained in a generally parallel relation; and a pair of spaced apart first lower bars pivotably attached to the first upper bars;

a second linkage including:

a pair of spaced apart second upper bars, each pivotably attached to the second support member;

a second cross member pivotably attached to the second upper bars such that the second upper bars are maintained in a generally parallel relation; and a pair of spaced apart second lower bars pivotably attached to the second upper bars;

wherein the first and second lower bars are pivotably connected to the lift bar such that the lower bars are maintained in a generally parallel relation;

wherein the first upper bars extend in a one of outwardly and inwardly direction from the first support member and the second upper bars extend in the other of outwardly and inwardly direction from the second support member;

a connection link pivotably connected to and extending between the first and second linkages and generally parallel to the lift bar; and a stabilizer extending between the first and second support members.

2. The boat lift of claim 1 and further comprising:

an actuator operably connected to one of the first and second support members and an anchor connected to the other of the first and second support members;

a first pulley connected to the lift bar proximate the first linkage; and a second pulley connected to the lift bar proximate the second linkage; and a cable, operably coupled to the actuator, the first and second pulleys, and the anchor.

3. The boat lift of claim 2 further comprising a third pulley operably coupled to the cable and attached to the first support member.

4. The boat lift of claim 2 wherein the stabilizer comprises:

a third linkage, including:

a pair of spaced apart third upper bars, each pivotably attached to the first support member;

a third cross member pivotably attached to the third upper bars such that the third upper bars are maintained in a generally parallel relation; and a pair of spaced apart third lower bars pivotably attached to the third upper bars;

a pair of spaced apart fourth upper bars, each pivotably attached to the second support member;

a fourth cross member pivotably attached to the second upper bars such that the fourth upper bars are maintained in a generally parallel relation; and a pair of spaced apart fourth lower bars pivotably attached to the fourth upper bars;

wherein the third and fourth lower bars are pivotably connected to a second lift bar, the second lift bar extending between the first and second support members, such that the third and fourth lower bars are maintained in a generally parallel relation;

wherein the third upper bars extend from the first support member in generally the same direction as the second upper bars and the fourth upper bars extend from the second support member in generally the same direction as the first upper bars; and a second connection link pivotably connected to and extending between the third and fourth linkages and generally parallel to the second lift bar.

5. The boat lift of claim 4 and further comprising a third pulley connected to the lift bar proximate the third linkage, a fourth pulley connected to the lift bar proximate the fourth linkage, a second cable, operably coupled to the actuator, and the third and fourth pulleys.

6. The boat lift of claim 5 wherein the first support member further includes:

a first pair of longitudinally spaced apart scissor links pivotably attached to the first support member;

a second pair of longitudinally spaced apart scissor links pivotably attached to the second support member;

a walkway extending between the first and second support members and pivotably attached to the scissor links; and a pair of spaced apart walkway supports pivotably attached to the scissor links, extending between the first and second support members, and generally parallel to the walkway.

7. The boat lift of claim 6 and further comprising:

a pair of first scissor pulleys attached to the walkway proximate the first pair of scissor links;

a pair of second scissor pulleys attached to the walkway proximate the second pair of scissor links;

a first walkway cable extending from one of the first pair of scissor pulleys to one of the second pair of scissor pulleys;

a second walkway cable extending from the other of the first pair of scissor pulleys to the other of the second pair of scissor pulleys; and wherein the firs and second walkway cables are operably connected to the actuator.

8. The boat lift of claim 2 further comprising:

a first scissor linkage having a plurality of first bars, the first scissor linkage pivotably attached to the first support member;

a second scissor linkage having a plurality of second bars, the second scissor linkage pivotably attached to the second support member;

a cross bar, pivotably attached to the first and second scissor linkages;

a first lower bar, pivotably attached to two first bars;

a second lower bar, pivotably attached to two second bars; and a walkway link, pivotably attached to the first and second lower bars, and generally parallel with a cross bar.

9. The boat lift of claim 8 further comprising:

a first scissor pulley connected to the cross bar proximate the first lower bar;

a second scissor pulley connected to the cross bar proximate the second lower bar; and a walkway cable operably connected to the first and second scissor pulleys and the actuator.

10. The boat lift of claim 9 further comprising:

a third scissor linkage having a plurality of third bars, the third scissor linkage pivotably attached to the first support member;

a fourth scissor linkage having a plurality of fourth bars, the fourth scissor linkage pivotably attached to the second support member;

a proximal cross bar, pivotably attached to the third and fourth scissor linkages and coupled to the cross bar;

a third lower bar, pivotably attached to the two third bars;

a fourth lower bar, pivotably attached to two fourth bars; and a proximal walkway link, pivotably attached to the third and fourth lower bars, generally parallel with the proximal cross bar.

11. The boat lift of claim 10 further comprising:

a third scissor pulley connected to the proximal cross bar proximate the third lower bar;

a fourth scissor pulley connected to the proximal cross bar proximate the fourth lower bar; and a proximal walkway cable operably connected to the third and fourth scissor pulleys and the actuator.

12. The boat lift of claim 1 wherein the first support member further includes:

a first pair of longitudinally spaced apart scissor links pivotably attached to the first support member;

a second pair of longitudinally spaced apart scissor links pivotably attached to the second support member;

a walkway extending between the first and second support members and pivotably attached to the scissor links; and a pair of spaced apart walkway supports pivotably attached to the scissor links, extending between the first and second support members and generally parallel to the walkway.

13. The boat lift of claim 12 wherein the stabilizer comprises:

a third linkage, including:

a pair of spaced apart third upper bars, each pivotably attached to the first support member;

a third cross member pivotably attached to the third upper bars such that the third upper bars are maintained in a generally parallel relation; and a pair of spaced apart third lower bars pivotably attached to the third upper bars;

a fourth linkage, including:

a pair of spaced apart fourth upper bars, each pivotably attached to the second support member;

a fourth cross member pivotably attached to the second upper bars such that the fourth upper bars are maintained in a generally parallel relation; and a pair of spaced apart fourth lower bars pivotably attached to the fourth upper bars;

wherein the third and fourth lower bars are pivotably connected to a second lift bar, extending between the first and second support members, such that the third and fourth lower bars are maintained in a generally parallel relation;

wherein the third upper bars extend from the first support member in generally the same direction as the second upper bars and the fourth upper bars extend from the second support member in generally the same direction as the first upper bars; and a second connection link pivotably connected to and extending between the third and fourth linkages and generally parallel to the second lift bar.

14. The boat lift of claim 1 wherein the stabilizer comprises:

a third linkage, including:

a pair of spaced apart third upper bars, each pivotably attached to the first support member;

a third cross member pivotably attached to the third upper bars such that the third upper bars are maintained in a generally parallel relation; and a pair of spaced apart third lower bars pivotably attached to the third upper bars;

a fourth linkage, including:

a pair of spaced apart fourth upper bars, each pivotably attached to the second support member;

a fourth cross member pivotably attached to the second upper bars such that the fourth upper bars are maintained in a generally parallel relation; and a pair of spaced apart fourth lower bars pivotably attached to the fourth upper bars;

wherein the third and fourth lower bars are pivotably connected to a second lift bar, extending between the first and second support members, such that the third and fourth lower bars are maintained in a generally parallel relation;

wherein the third upper bars extend from the first support member in generally the same direction as second upper bars and the fourth upper bars extend from the second support member in generally the same direction as the first upper bars; and a second connection link pivotably connected to and extending between the third and fourth linkages and generally parallel to the second lift bar.

15. The boat lift of claim 1 further comprising:

an actuator connected to a first pulley block;

a second pulley block operably connected to the actuator and the first and second linkages, the second pulley block having a range of travel;

a locking port connected to the frame and in the range of travel;

a locking assembly, including:

a toggle operably connected to the first pulley block;

a locking pin operably connected to the toggle and the locking port; and a lock pin release operably connected to the locking pin and operably connected to the second pulley block;

wherein the actuator is movable:

from a starting position to a first position, wherein the second pulley block is within the locking port and engaged with the lock pin release;

from the first position toward the starting position to a second position wherein the locking pin is engaged with the second pulley block;

from the second position toward the starting position to a third position wherein the first pulley block engages the toggle reset; and from the third position toward the first position to a fourth position wherein the second pulley block engages the lock pin release and disengages the locking pin from the second pulley block.

16. The boat lift of claim 15 wherein the actuator is movable from the fourth position to the starting position.

17. The boat lift of claim 16 wherein:

the lift bar is urged toward the frame when the actuator is moved from the starting position to the first position; and the lift bar is urged away from the frame when the actuator is moved from the fourth position to the starting position.

18. The boat lift of claim 16 wherein the locking assembly is reset when the actuator is moved from the fourth position to the starting position.

* * * * *